US005265390A

United States Patent [19]

Tanner

[11] Patent Number: 5,265,390

[45] Date of Patent: Nov. 30, 1993

[54] WALL PANELS AND METHODS OF CONSTRUCTION THEREOF

[75] Inventor: John K. Tanner, 5 Beverly Close, Winchmore Hill, London N21 3JB, England

[73] Assignee: John K. Tanner, London, England

[21] Appl. No.: 637,324

[22] Filed: Jan. 3, 1991

[30] Foreign Application Priority Data

Jan. 25, 1990 [GB] United Kingdom ..... 9001703

[51] Int. Cl.[5] ..... E04H 14/00

[52] U.S. Cl. ..... 52/233; 52/243.1

[58] Field of Search ..... 52/90, 233, 574, 586, 52/93, 243.1, 126.5

[56] References Cited

U.S. PATENT DOCUMENTS

| | | | |
|---|---|---|---|
| 3,292,321 | 12/1966 | Vander Schans | 52/243.1 |
| 3,979,862 | 9/1976 | Hamilton et al. . | |
| 4,186,534 | 2/1980 | Le Cose | 52/243.1 X |
| 4,250,677 | 2/1981 | Yablonski | 52/233 |
| 4,825,610 | 5/1989 | Gasteiger | 52/243.1 X |

FOREIGN PATENT DOCUMENTS

| | | | |
|---|---|---|---|
| 2557231 | 6/1977 | Fed. Rep. of Germany . | |
| 3804525 | 8/1989 | Fed. Rep. of Germany . | |
| 2456177 | 12/1980 | France . | |
| 2486858 | 1/1982 | France . | |
| 124996 | 11/1961 | New Zealand . | |
| 126959 | 3/1963 | New Zealand . | |
| 130658 | 9/1964 | New Zealand . | |
| 169869 | 4/1974 | New Zealand . | |
| 180673 | 3/1979 | New Zealand . | |
| 180508 | 11/1980 | New Zealand . | |
| 186060 | 11/1981 | New Zealand . | |
| 193313 | 7/1984 | New Zealand . | |
| 197910 | 7/1984 | New Zealand . | |
| 212519 | 11/1988 | New Zealand . | |
| 318984 | 12/1969 | Sweden | 52/233 |
| 879936 | 11/1961 | United Kingdom . | |
| 1260281 | 3/1969 | United Kingdom . | |
| 1422719 | 2/1973 | United Kingdom . | |
| 8000357 | 3/1980 | World Int. Prop. O. | 52/243.1 |

OTHER PUBLICATIONS

K. G. Götz et al., pp. 242, 243, 270, 271, Moscow SI, 1985.

*Primary Examiner*—Carl D. Friedman
*Assistant Examiner*—Creighton Smith

[57] ABSTRACT

A wall panel comprises at least two standards, a plurality of logs which are supported by and movable relative to the standards and a plurality of preferably self-compensating jacks which support a load, for example a roof or an upper storey, above the upper edge of the uppermost log, the self-compensating jacks supporting the load with preferably a constant force irrespective of vertical movement between the upper edge of the uppermost log and the load caused by, for example, settlement or shrinkage.

13 Claims, 2 Drawing Sheets

WALL PANELS AND METHODS OF CONSTRUCTION THEREOF

BACKGROUND OF THE INVENTION

This invention relates to wall panels and also relates to methods of construction of wall panels.

It is known for a log wall to be formed from a plurality of wooden logs. The logs which make up the log wall are generally unstable and tend to shrink even if they have been kiln dried prior to use. The shrinkage or settlement of logs usually has a two-fold effect. Firstly, gaps are created between the logs making up the log wall, thus rendering any house comprising the log walls drafty and susceptible to water leakage. This necessitates a continuous blocking of the gaps.

Secondly, settlement of the logs in the outer walls of a log construction results in a reduction in height of the walls, which in turn affects the position of any structures supported by the walls. This tends to destabilise the entire construction, often also resulting in the non-closure of doors and windows.

SUMMARY OF THE INVENTION

According to a first aspect of the present invention, a wall panel comprises a wall element and at least two upright support elements, the wall element being movable relative to the support elements, and at least one support means being for supporting a load above the upper edge of the wall panel irrespective of vertical movement between the upper edge of the wall panel and the load.

Preferably, the support means is adapted to support the load with a substantially constant force irrespective of vertical movement between the upper edge of the wall panel and the load.

The support means may be an automatic mechanical jack, a hydraulic jack or a spring jack.

A plurality of the support means, mounted at positions equidistant from one another, may be mounted on the upper edge of the wall panel.

Each upright support element preferably defines at least one channel within which an edge the wall element is slidably received.

Preferably, the wall element has tongues extending from its opposed upright edges, each tongue being slidably received within the channel defined in the respective upright support element.

The wall element preferably comprises a plurality of elongate members stacked one on top of the other.

The elongate members are preferably movable in an upright plane relative to one another and to the upright support elements.

The wall panel may rest on a base member which supports the lower edge of the wall panel.

A ring beam, which may be made up of several ringbeam elements, may be positioned between the support means and the load.

The elongate wall elements and the upright support elements are preferably made of wood and are preferably treated with a preservative to render them less susceptible to climatic changes.

According to a second aspect of the present invention a method of constructing a wall panel comprises the steps of erecting at least two upright support elements, placing a wall element between the upright support elements so that it is movable relative to the upright support elements and mounting at least one support means for supporting a load on the upper edge of the wall panel, the support means being capable, in use, of supporting the load irrespective of vertical movement between the upper edge of the wall panel and the load.

According to a third aspect of the present invention a building comprises a plurality of wall panels of the invention, the load being constituted by a roof or an upper storey of the building.

Further scope of applicability of the present invention will become apparent from the detailed description given hereinafter. However, it should be understood that the detailed description and specific examples, while indicating preferred embodiments of the inventions are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DESCRIPTION OF EMBODIMENTS

Figure 1:
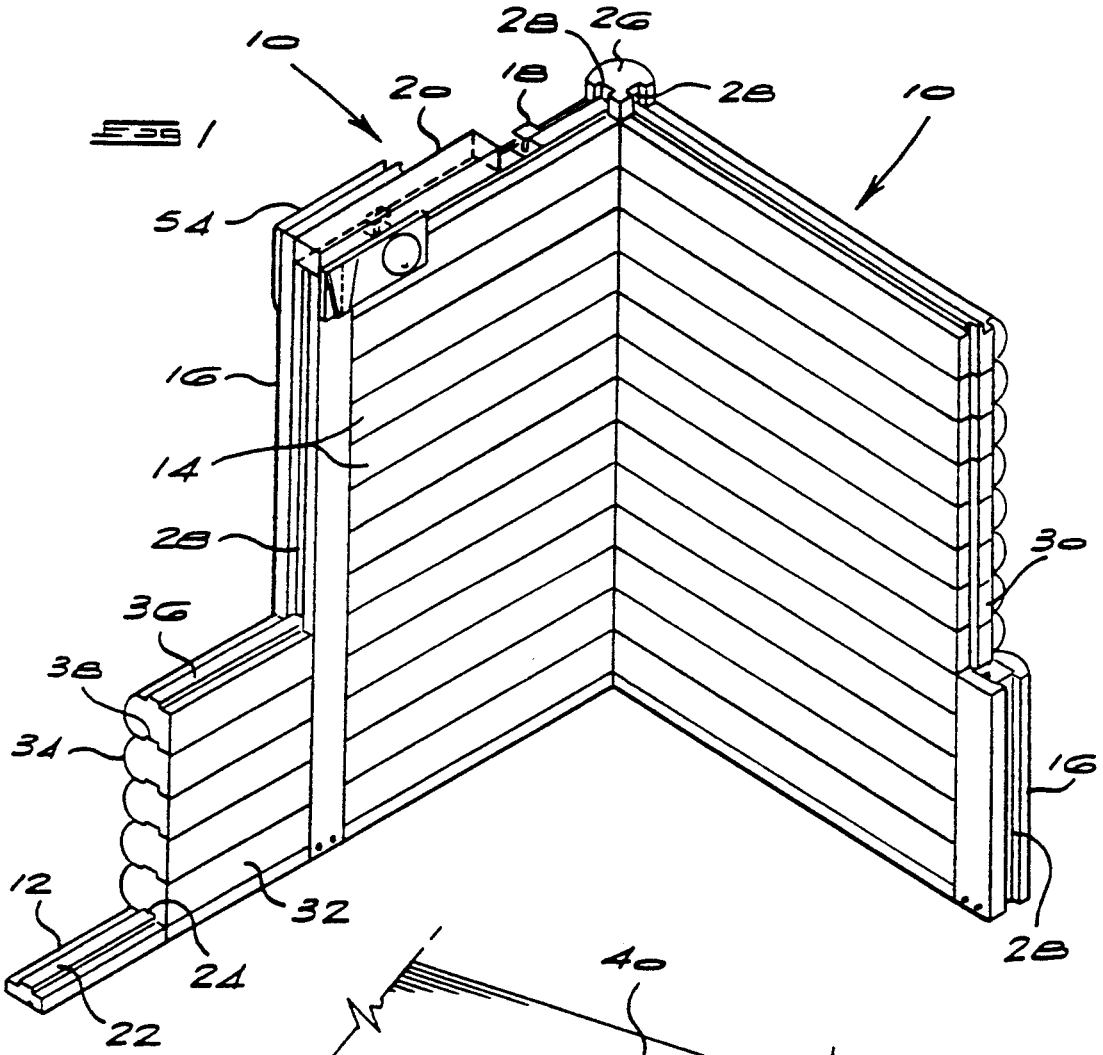
FIG. 1 is a pictorial view of a plurality of wall panels according to the invention.
Figure 2:
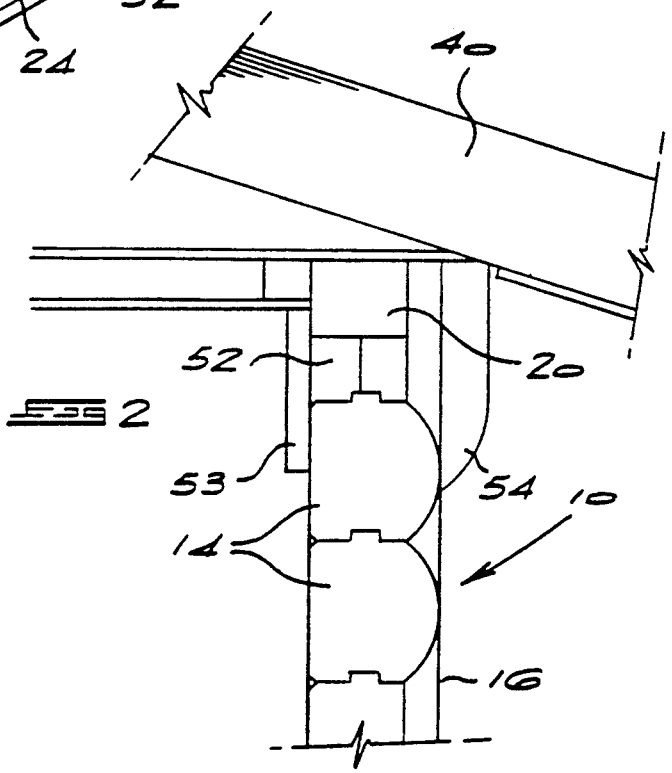
FIG. 2 is a sectional side view of a wall panel according to the invention.

The wall panels 10 illustrated in FIGS. 1 and 2 each comprise a base plate 12, a plurality of wooden logs 14, a pair of standards 16 and 26, and at least one jack 18 mounted on the upper edge of each wall panel 10. A ringbeam element 20 is supported by the jacks 18.

The base plate 12 is wooden and has a central ridge 22 defined thereon which slots into a corresponding groove 24 in the lowest log of the wall panel 10. The base plate 12 is anchored to a foundation which can be a standard concrete foundation or a wooden foundation, for example.

A number of different types of standards can be used. The type of standard used varies according to the position it occupies in a construction. The standards 26 occupy the corner positions in a construction and are generally crescent-shaped in section, with a rounded outer surface. The standards 16 occupy positions intermediate the corners in a construction and are generally H-shaped, with flat inner and rounded outer surfaces.

The standards 16 and 26 have pairs of opposed channels 28 defined therein. The channels 28 are sized to accommodate tongues 30 extending from respective ends of each log 14. The logs 14, which have a smooth inside face 32 and a rounded outside face 34, have tongues 36 and grooves 38 defined on their respective upper and lower edges. The logs 14 mate with one another without being fixed together so that each log 14 can move separately relative to the standards 16 and 26.

A sealant strip (not shown) runs along the groove in each log so that a weatherproof seal is created between abutting edges of vertically adjacent logs 14. The sealant strip may, for example, be of foam rubber.

One or more window frames (not shown) can be placed at selected positions within the wall panel 10. Door frames (not shown) can conveniently be placed between any adjacent standards 16 or 16 and 26. The window and door frames are shaped with edges which can be accommodated within the channels 28 of the standards 16 and 26 and are movable vertically within the channels 28.

During construction of structures incorporating the wall panel 10, a ring beam, made up of several ringbeam elements 20, is secured to the tops of the standards 16 and 26. This is done with the use of nailplates or the like (not shown) to obtain a relatively integral frame for the entire structure. A number of self-compensating jacks are used to support the ring beam. The jacks are installed between the underside of the ring beam and the upper log in each wall panel. When the jacks are activated, the standards are, in effect, placed in tension and the entire load to be borne by the ring beam will now be transferred, through the jacks, to the logs in the panels.

Figure 3:
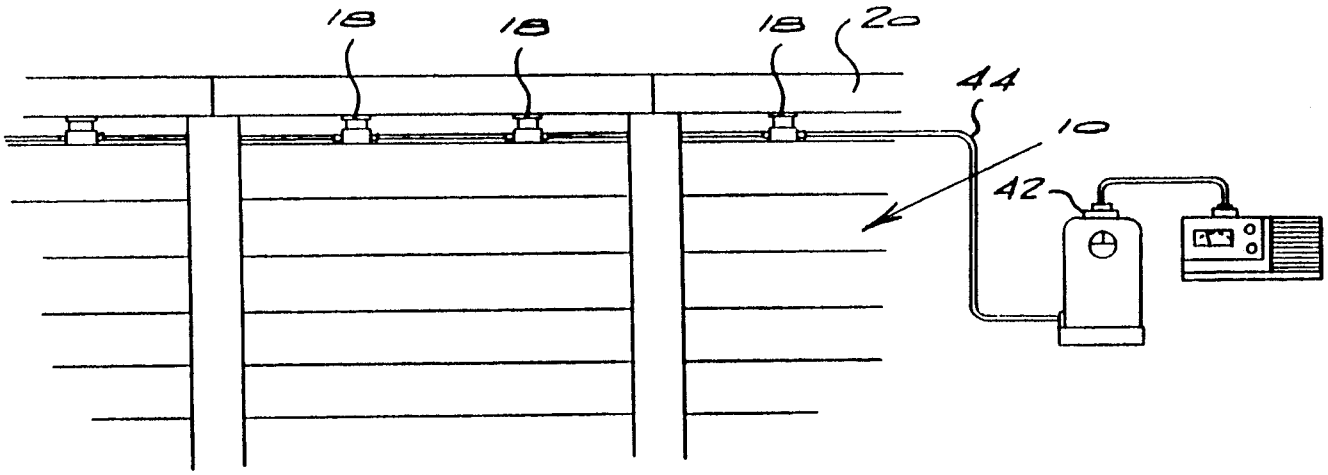
FIG. 3 is a schematic representation of one type of support means according to the invention.
Figure 4:
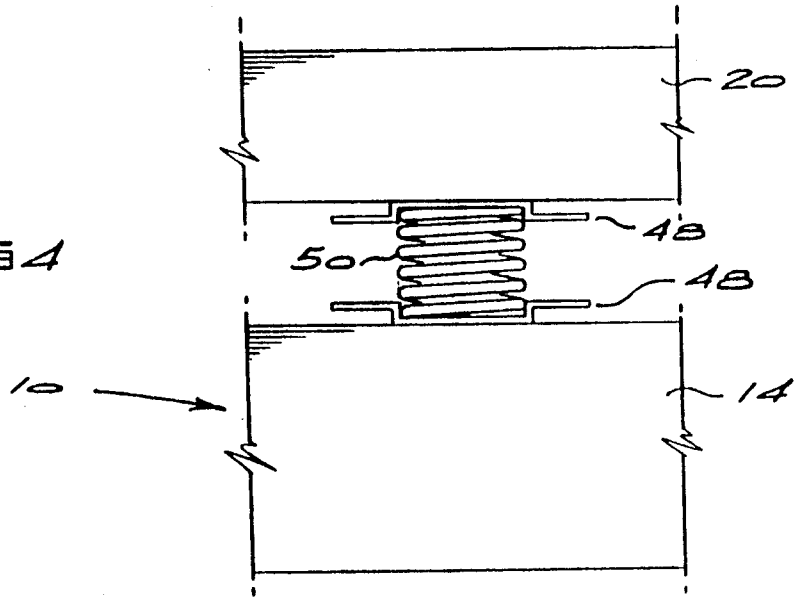
FIG. 4 is a schematic representation of a second type of support means according to the invention.

In FIGS. 3 and 4 a pair of such self-compensating jacks 18 are placed at equidistant intervals on the upper edge of each wall panel 10 and they support the ringbeam element 20 and any load attached to it at a substantially constant altitude, irrespective of any movement of the logs 14 due to settlement or shrinkage. The self-compensating jacks 18 thus automatically maintain the height of the ringbeam element constant, thereby preventing any distortion which may occur in a wall or building as result of any variation in the height of a wall panel 10.

Attached to the ringbeam element 20, as illustrated in FIG. 2, are either roof trusses 40 or the upper storey of a double storey construction.

The jacks 18 illustrated in FIG. 3 are hydraulic jacks, each extending between the upper edge of a wall panel 10 and the respective ringbeam element 20. Each hydraulic jack 18 is linked to a hydraulic pump 42 by a pipe 44 which also runs along the upper edges of the wall panels 10. These jacks have an advantage in that they can apply a substantially constant force to the ringbeam element 20 to support it and any load attached to it at a constant altitude, notwithstanding relative movement between the upper edge of the wall panel and the ringbeam element 20.

The jack illustrated in FIG. 4 is a self compensating spring jack. The spring jack has a pair of end plates 48 and a long travel spring 50 located between the end plates. The end plates 48 bear against the ringbeam element 20 and the upper edge of the respective wall panel 10, with the spring 50 under compression. The spring 50 expands automatically with any decrease in altitude of the upper edge of the wall panel 10 due to settlement or shrinkage of the logs 14 to support any load bearing on the ringbeam element 20 at a substantially constant altitude. Naturally, the force exerted by the spring 50 varies with the degree of compression thereof. However, the long travel of the spring ensures that the ringbeam element 20 is supported with an approximately constant force, maintaining it at a substantially constant altitude, even if the vertical movement of the wall panel is substantial.

A void 52, (illustrated in FIG. 2) within which the jacks 18 are accommodated, extends between the upper edge of each wall panel 10 and the respective ringbeam element 20. The void 52 is closed off by means of an internal cover strip 53 which is attached to the standards with screws, nails or the like. Externally the void 52 is closed by an external cover strip 54 secured to the standards 16, 26. The cover strips 53, 54 seal the void 52 but do not impede the vertical movement of the wall panels 14 relatively to the standards 16 and 26.

The wooden parts of the wall panel 10 are all treated with a preservative under pressure so that the preservative impregnates each wooden element. The preservative serves to reduce shrinkage in the wood and also makes it less susceptible to climatic changes.

The wall panels of the invention can maintain any load, for example a roof truss or an upper storey floor supported by the wall panel, at a substantially constant altitude irrespective of any vertical movement of the logs in the wall panel due to shrinkage or settlement, thereby reducing structural instability and any resultant distortion in a structure formed from the wall panels.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A wall panel comprising a wall element and at least two upright support elements, the wall element being movable relative to the support elements, and at least one force-applying support means for applying a force between the upper edge of the wall element and a reaction member for enabling vertical movement of the wall element relative to the support elements wherein the reaction member is an external load and a load bearing element and the force applying support means applies a substantially constant force to support the reaction member at a substantially constant altitude.

2. The wall panel according to claim 1, wherein the support means is a long-travel spring jack.

3. The wall panel according to claim 1, wherein the support means is a hydraulic jack.

4. The wall panel according to claim 1, wherein a plurality of the support means are mounted on the upper edge of the wall element.

5. The wall panel according to claim 4, wherein the support means are mounted at positions equidistant from one another.

6. The wall panel according to claim 1, wherein each of the upright support elements defines at least one channel within which an edge of the wall element is slidably received.

7. The wall panel according to claim 6, wherein the wall element has tongues extending from opposed upright edges there of, each tongue being slidably received within the channel defined in the respective upright support element.

8. The wall panel according to claim 1, wherein the wall element comprises a plurality of elongate members stacked one on top of the other.

9. A wall panel according to claim 8, wherein the elongate members are movable in an upright plane relative to one another and to the upright support elements, and each of the elongate members has a tongue and a groove defined on upper and lower edges respectively to allow mating of vertically adjacent elongate members.

10. A wall panel according to claim 1 further comprising a base member on which the wall element and at least two upright support elements rest.

11. The wall panel according to claim 1, wherein the wall element is made of wood.

12. The wall panel according to claim 1, wherein the at least two upright support elements are made of wood.

13. A building comprising a plurality of wall panels according to claim 1 with the load being constituted by a roof or an upper storey of the building.

* * * * *